United States Patent [19]

Miller et al.

[11] 4,219,313

[45] Aug. 26, 1980

[54] COMMUTATOR VALVE CONSTRUCTION

[75] Inventors: Laurence L. Miller, West Lafayette; Terry E. Hilt, Lafayette, both of Ind.

[73] Assignee: TRW Inc., Cleveland, Ohio

[21] Appl. No.: 928,738

[22] Filed: Jul. 28, 1978

[51] Int. Cl.[2] ..... F03C 3/00; F04C 1/02; F04C 15/02; F16K 37/00

[52] U.S. Cl. ..... 418/2; 418/39; 418/61 B; 137/270

[58] Field of Search ..... 418/2, 39, 61 B; 137/269, 270

[56] References Cited

U.S. PATENT DOCUMENTS

| | | | |
|---|---|---|---|
| 2,797,707 | 7/1957 | Hursh | 137/633 |
| 2,947,320 | 8/1960 | Oxley et al. | 137/271 |
| 3,799,201 | 3/1974 | Hansen et al. | 418/61 B |
| 3,876,343 | 4/1975 | Giversen | 418/61 B |
| 3,901,267 | 8/1975 | Moon, Jr. | 137/270 |
| 4,072,450 | 2/1978 | Carlson | 418/133 |
| 4,087,215 | 5/1978 | Miller | 418/61 B |

*Primary Examiner*—John J. Vrablik

[57] ABSTRACT

An assembly of plate members for forming a commutator valve for hydraulic devices of the expanding-contracting pocket type, such as hydraulic motors. The assembly includes a first end plate, a second end plate and a plurality of intermediate plates therebetween. The first end plate includes first and second arrays of fluid passageways for communicating with expanding and contracting fluid pockets, respectively, during operation of the motor. The intermediate plates may be assembled together in either a first or a second alignment depending upon the desired direction of rotation of the hydraulic motor. The intermediate plates are designed such that in the first alignment they direct high pressure fluid from a high pressure port to the first array of passageways and low pressure fluid from the second array of passageways to a low pressure port. The output shaft of the hydraulic motor thus rotates in one direction. In the second alignment the intermediate plates direct high pressure fluid from the high pressure port to the second array of passageways and low pressure fluid from the first array of passageways to the low pressure port. The output shaft of the hydraulic motor thus rotates in the reverse direction. Certain plate members have indicia which identifies the direction in which the output shaft of the motor will rotate.

14 Claims, 17 Drawing Figures

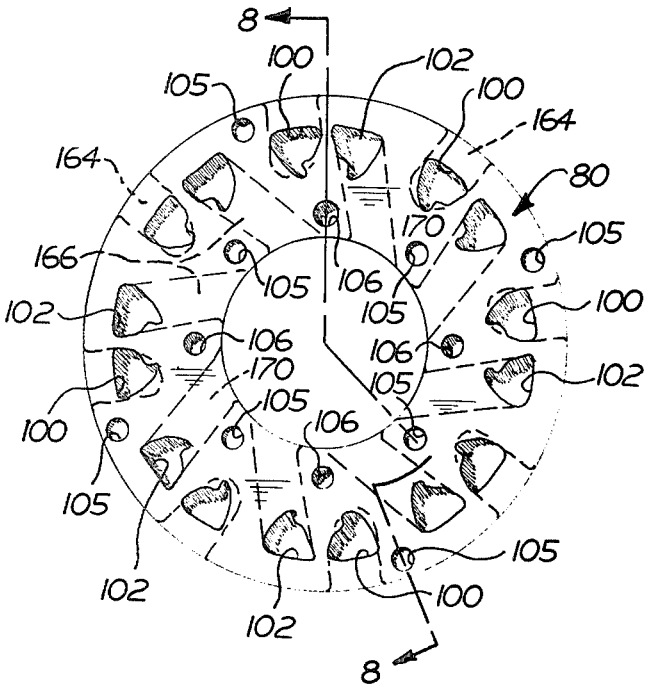
FIG. 6
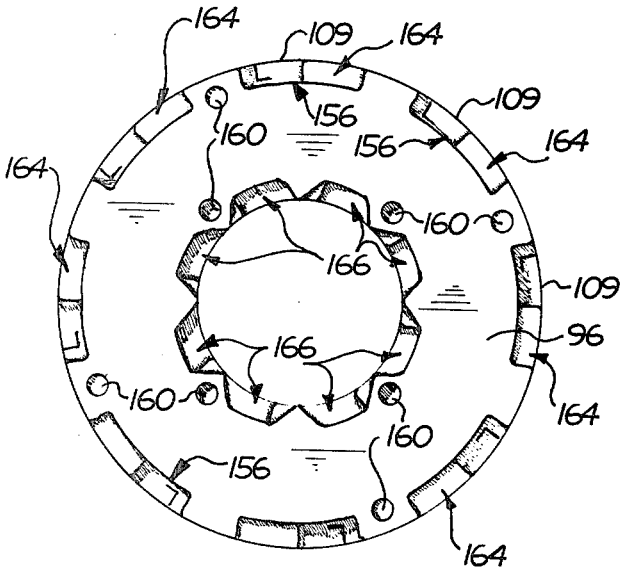
FIG. 7
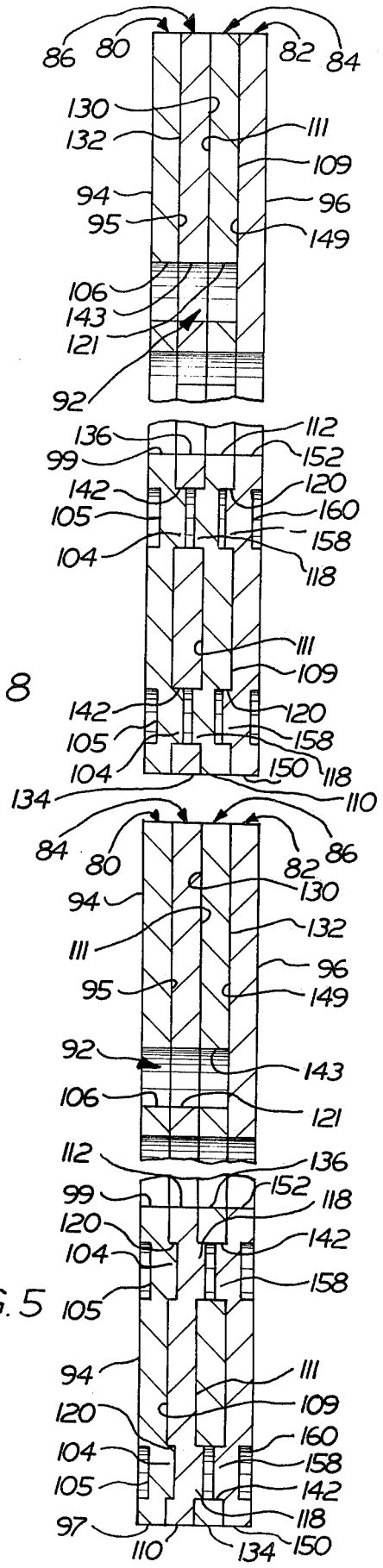
FIG. 8
FIG. 5

COMMUTATOR VALVE CONSTRUCTION

BACKGROUND AND SUMMARY OF THE INVENTION

This invention relates to commutator valves for hydraulic devices of the expanding-contracting pocket type, such as hydraulic motors. Specifically, it relates to an assembly of plate members adapted to be fixed together to form a commutator valve for a device such as a hydraulic motor. In particular, it relates to a single set of plate members which when assembled in one relationship effect rotation of the motor in one direction, and when assembled in another relationship effect rotation of the motor in a reverse direction without changing the high or low pressure ports of the motor.

A known commutator valve construction for a hydraulic motor is shown in U.S. application Ser. No. 706,131 now U.S. Pat. No. 4,087,215. The commutator valve is formed by three plate members which are brazed together. The plate members include a pair of end plates, and a specially formed central plate. The central plate controls the flow of fluid in such a manner that the valve directs high pressure fluid from a high pressure inlet port to expanding pockets and directs low pressure fluid from contracting pockets to a low pressure outlet port to rotate an output shaft in one direction.

One way of reversing the direction of rotation of the output shaft of the motor is to reverse the ports, i.e., to direct high pressure fluid to the previous outlet port and low pressure fluid from the previous inlet port.

Another way of reversing the direction of rotation of the output shaft of the motor is to vary the commutator valve construction. This could be accomplished by varying the construction of the central plate depending upon the direction of rotation desired.

The present invention provides a unique assembly of plate members which are designed to be assembled and fixed together to form a commutator valve for hydraulic devices such as hydraulic motors. In the preferred embodiment a single set of plate members are assembled in one of two different alignments to form the commutator valve, depending upon the desired direction of rotation of the output shaft of the motor.

Thus, constructing a commutator valve according to the present invention avoids the necessity of either reversing the high and low pressure ports for reversing the direction of rotation of a motor, and also avoids the necessity of forming specially constructed commutator valve parts for this purpose.

The assembly of plate members includes a first end plate, a second end plate and a plurality of intermediate plates disposed therebetween. The first end plate includes first and second arrays of fluid passageways for communicating with expansible and contractable pockets, respectively, during operation of the device. The intermediate plates are designed such that in a first alignment they direct high pressure fluid from the high pressure port to the first array of passageways and low pressure fluid from the second array of passageways to the low pressure port. In a hydraulic motor, they direct fluid to cause the output shaft to rotate in one direction. In a second alignment the intermediate plates direct high pressure fluid from the high pressure port to the second array of passageways and low pressure fluid from the first array of passageways to the low pressure port. In the second alignment, they direct fluid to cause the motor output shaft to rotate in a reverse direction. Certain of the plates have indicia for identifying which alignment the plates are assembled in.

The end plates and intermediate plates are preferably thin, and of equal thickness. Thus, the single set of plate members can be stamped from sheet metal stock from the same heat. This is believed to enhance the compatibility of the plates for being brazed together to form the commutator valve.

BRIEF DESCRIPTION OF THE DRAWINGS

Further objects and advantages of the present invention will become apparent from the following detailed description of a preferred embodiment taken with reference to the accompanying drawings wherein:

FIG. 5 is an enlarged fragmentary sectional view of the commutator valve of FIG. 3 taken along section line 5—5 of FIG. 3;

FIG. 6 is a view of one axial end of a commutator valve formed by the same plate members as the commutator valve of FIG. 3 but in another alignment which causes rotation of the motor output in a reverse direction according to the principles of the invention;

FIG. 7 is a view of the other axial end of the commutator valve of FIG. 6;

FIG. 8 is an enlarged fragmentary sectional view of the commutator valve of FIG. 6, taken along the section line 8—8 of FIG. 6;

DETAILED DESCRIPTION OF THE PREFERRED EMBODIMENT

Figure 1:
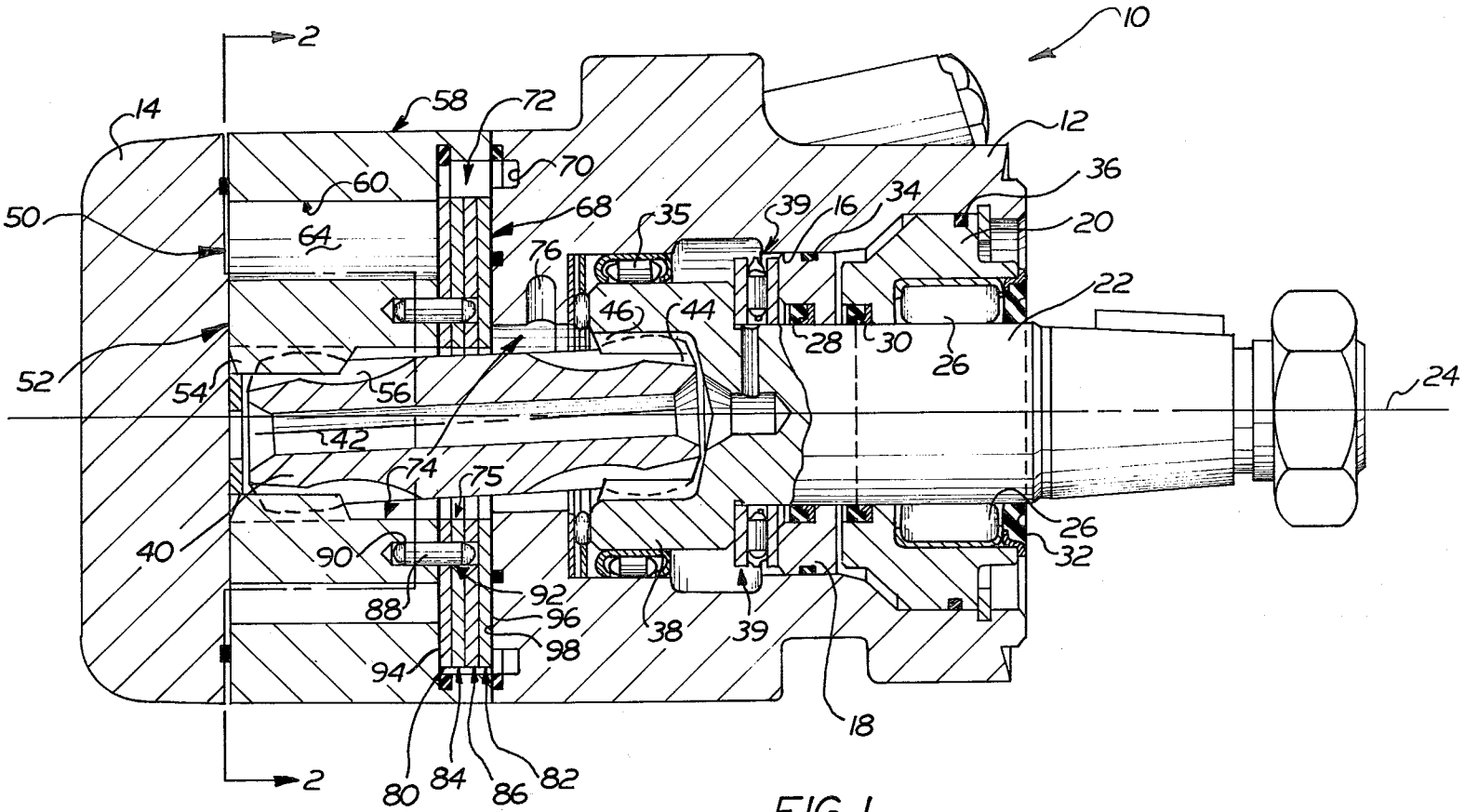
FIG. 1 is a longitudinal sectional view of a motor having a commutator valve constructed according to the principles of the present invention.

As noted above, the present invention relates to an assembly of plate members which form a commutator valve for controlling fluid flow in a hydraulic device of the expanding-contracting pocket type, such as a hydraulic motor. A commutator valve constructed according to the present invention includes a single set of plates which are assembled together in one of two different arrangements. In one arrangement, the commutator valve directs fluid between the inlet and outlet ports of the motor and the fluid pockets so that the motor output shaft rotates in one direction. In another arrangement the commutator valve directs fluid between the inlet and outlet ports and the fluid pockets so that the output shaft rotates in the opposite direction. FIG. 1 shows a hydraulic motor 10 which is merely representative of the type of hydraulic device with which the commutator valve of the present invention may be associated.

The hydraulic motor 10 includes housing sections 12 and 14. Housing Section 12 includes a central bore 16. A seal support gland 18, and an end closure member 20 are located in the bore 16. The gland 18 and the closure member 20 support an output shaft 22 for rotation about its central axis 24. Roller bearing support for the shaft 22 is provided by roller bearing members 26.

A dynamic sealing member 28, preferably formed of polytetrafluoroethylene (PTFE) is disposed between the gland 18 and the shaft 22. Dynamic sealing members 30, 32, also formed of PTFE are disposed between the closure member 20 and the shaft 22. Static sealing members 34, 36 are disposed between the members 18, 20, respectively, and the walls of bore 16.

The inner end of shaft 22 includes an enlarged head 38. Enlarged head 38 is supported by roller bearings 35, and axial thrust bearings 39 of known construction.

The enlarged head 38 of shaft 22 is connected with one end of a wobble shaft 40. The wobble shaft 40 is rotatable about its central axis 42 which is disposed at an angle to the central axis 24 of the shaft 22. A series of external splines 44 at the one end of the wobble shaft 40 drivingly engage internal splines 46 on the enlarged head 38 and effect rotation of the enlarged head 38 and thereby the output shaft 22 at the speed of rotation of the wobble shaft 40.

Figure 2:
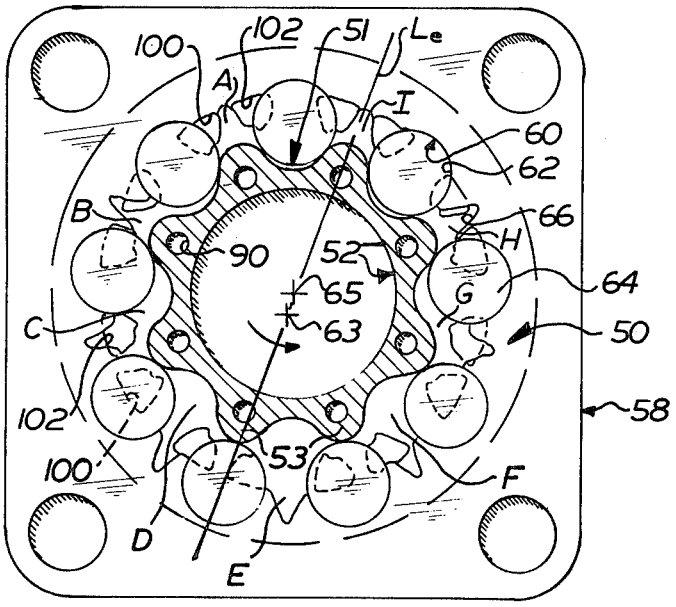
FIG. 2 is a view of the motor of FIG. 1, taken approximately along section line 2—2 of FIG. 1 with the rotational position of certain elements changed and with certain elements omitted.

The other end of the wobble shaft 40 is connected to one of the gear members of a gerotor gearset. Referring to FIGS. 1 and 2, the gerotor gearset includes an internally toothed gear member 50, herein referred to as a stator, and an externally toothed gear member 52, herein referred to as a rotor.

Stator 50 comprises plate 58 (see FIGS. 1 and 2) fixed between housing sections 12, 14 by bolts (not shown). Plate 58 has an internal surface 60 forming a series of circumferentially spaced arcuate recesses 62 (FIG. 2). A cylindrical roller vane 64 is rotatable and circumferentially shiftable in each arcuate recess. The roller vanes 64 form the internal teeth 51 of the stator 50.

As illustrated in FIG. 2, the rotor 52 has a series of external teeth 53 which engage the internal teeth 51 of the stator. The rotor 52 has one less tooth than the stator 50. Additionally, the central axis 65 of the rotor is eccentrically disposed relative to the central axis 63 of the stator. Upon application of a force couple to the gearset the rotor rotates about its own axis 65 and orbits about the central axis 63 of the stator, as is well known.

Referring to FIG. 1, rotor 52 includes internal splines 54 which drivingly engage external splines 56 at an end of the wobble shaft 40 to rotate the wobble shaft about its central axis 42 at the speed of rotation of the rotor. The spline connections between the wobble shaft 40, the rotor 52 and the enlarged head 38 are designed to allow the wobble shaft to rock relative to the rotor and the enlarged head 38 as the end of the wobble shaft connected with the rotor rotates and orbits along with the rotor. Thus, rotary and orbital movement of the rotor rotates the output shaft 22.

The intermeshing teeth of the stator 50 and the rotor 52 define a series of axially extending fluid pockets (A-I, FIG. 2). These pockets expand and contract as the rotor rotates and orbits relative to the stator. As seen in FIG. 2, the fluid pockets A, B, C, and D are expanding the pockets E, F, G, and H are contracting. Expanding pockets A, B, C, and D are disposed on one side of a line of eccentricity $L_e$ defined by a line through the central axis 63 of the stator and the central axis 65 of the rotor. Contracting pockets E, F, G, and H are disposed on the other side of the line of eccentricity $L_e$. Pocket I is intersected by the line of eccentricity $L_e$.

The motor 10 includes a commutator valve 68 which directs fluid from a high pressure inlet port to the pockets on one side of the line of eccentricity $L_e$ and directs fluid from the fluid pockets on the other side of the line of eccentricity to a low pressure outlet port. When the parts are in the position of FIG. 2, high pressure fluid is directed by commutator valve 68 to the pockets A, B, C, and D, and pockets E, F, G and H are connected to low pressure by the commutator valve 68. The pocket I is, in effect, instantaneously blocked by the commutator valve. This places a force couple on the gearset resulting in orbital and rotational movement of the rotor and expansion and contraction of the pockets. As the rotor rotates and orbits, the line of eccentricity $L_e$ of course, becomes located between different pockets, as is well known. In fact, all pockets expand as well as contract during operation of the motor. The rotation of the rotor is transmitted through the wobble shaft 40 to the output shaft 22.

High pressure fluid acts on the roller vanes 64 to force the roller vanes into sealing engagement with the rotor teeth to seal the high pressure pockets from the low pressure pockets. This construction is in accordance with the principles of U.S. Pat. No. 3,289,602.

The internal surface 60 of plate 58 also forms a notch 66 located between each pair of arcuate recesses 62. The notches 66 render portions of the arcuate recesses 62 resiliently deflectable as a function of the forces applied to the roller vanes 64, and this construction reduces wear on the roller vanes. The construction of a gearset having notches such as 66 is described in greater detail in U.S. Pat. No. 4,087,215.

In the motor shown in FIG. 1, high pressure fluid is directed from a high pressure inlet port (not shown) to a high pressure groove 70 in the housing section 12. Groove 70 communicates high pressure fluid to a high pressure space 72 surrounding the outer periphery of the commutator valve 68. The commutator valve 68 directs the high pressure fluid from space 72 to the expanding pockets and directs low pressure fluid from the contracting pockets to a central opening 75 in the commutator valve 68. The central opening 75 encircles part of the wobble shaft 40 and forms part of a low pressure space 74. A low pressure groove 76 formed in housing 12, communicates with the low pressure space 74 to direct low pressure fluid to an outlet port (not shown).

As seen in FIG. 1, the commutator valve 68 is disposed adjacent one axial side of the gerotor gearset. The commutator valve 68 is connected to the rotor 52 by means of a series of pins 88 which engage recesses 90, 92 in the rotor and the commutator valve 68, respectively.

Thus, the valve 68 rotates and orbits along with the rotor 52.

As the commutator valve 68 rotates and orbits with the rotor 52 it directs fluid to and from the pockets defined by the teeth of the gearset and thus causes a continuous rotaton of the shaft 22. Such operation is known from U.S. Pat. No. 4,087,215.

Figure 10:
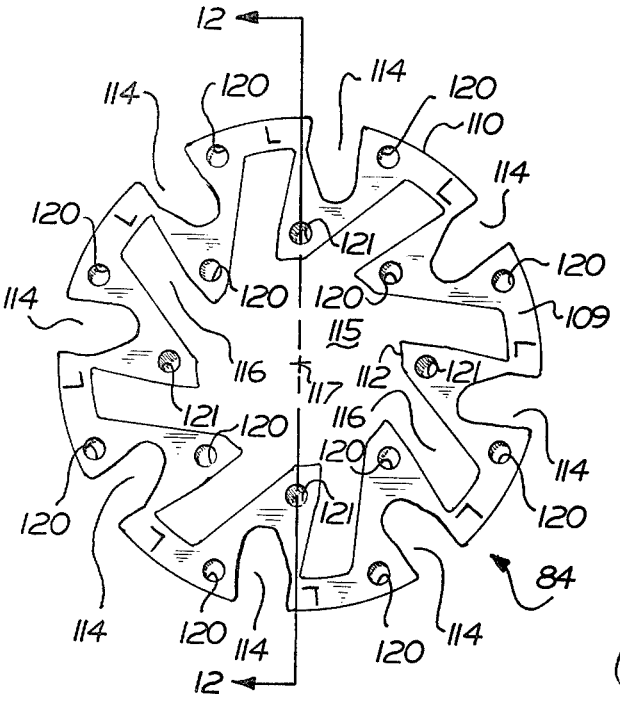
FIGS. 10 and 11 are views of both axial end faces of one of the intermediate plate members used to construct the commutator valves of FIGS. 3 and 6.
Figure 11:
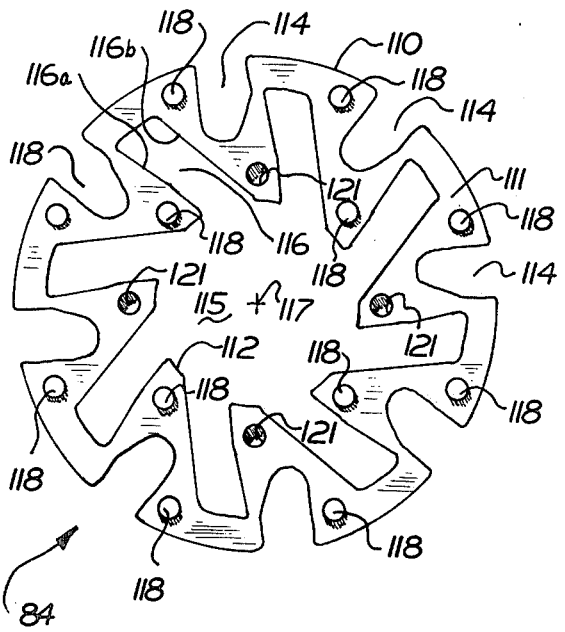
Figure 12:
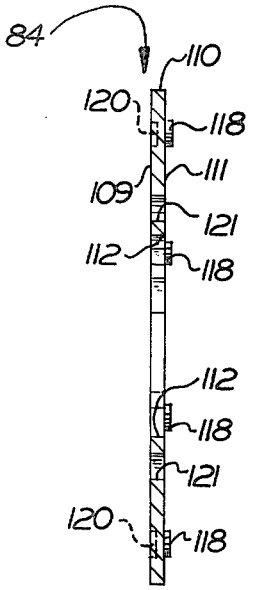
FIG. 12 is a sectional view of the plate member of FIG. 10, taken along the section line 12—12 of FIG. 10.

The commutator valve 68 includes a pair of spaced end plates 80, 82 and a pair of intermediate plates 84, 86 disposed therebetween in either a first alignment (shown in FIGS. 1–5) or a second alignment (shown in FIGS. 10–12). The alignment of the intermediate plates 84, 86 determines the direction of rotation of shaft 22. The end plates and intermediate plates are fixedly secured together, as discussed hereinafter.

Figure 3:
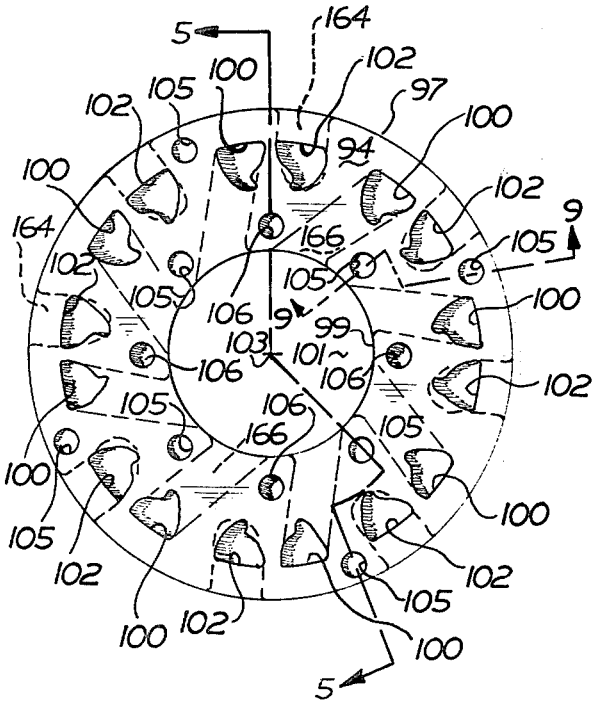
FIG. 3 is a view of one axial end of a commutator valve formed by an assembly of plate members in an alignment which causes the output shaft of the motor of FIG. 1 to rotate in one direction, according to the principles of the invention.
Figure 9:
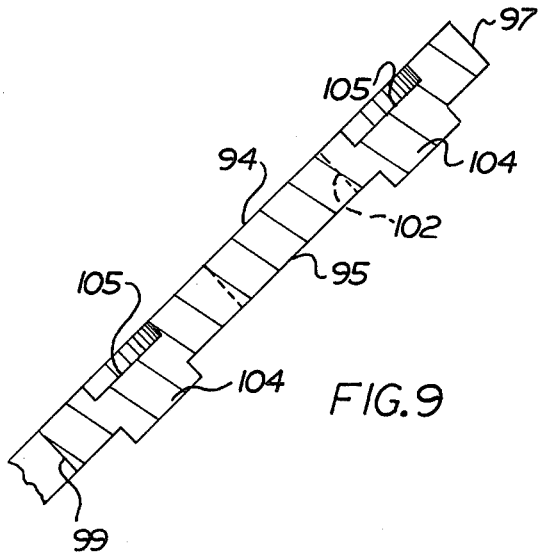
FIG. 9 is an enlarged sectional view of one end plate of the commutator valve of FIG. 3 taken along the section line 9—9 of FIG. 3.
Figure 13:
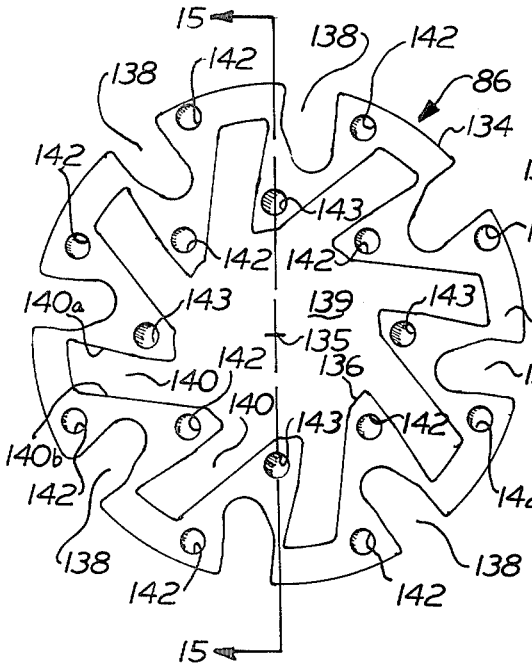
FIGS. 13 and 14 are views of the axial end faces of another intermediate plate member used to construct the commutator valves of FIGS. 3 and 6.
Figure 15:
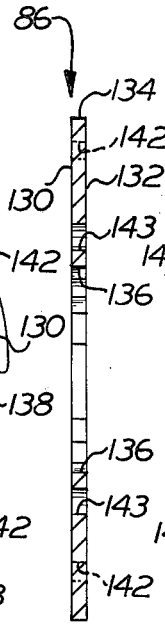
FIG. 15 is a sectional view of the plate member of FIG. 13 taken along the section line 15—15 of FIG. 13.
Figure 14:
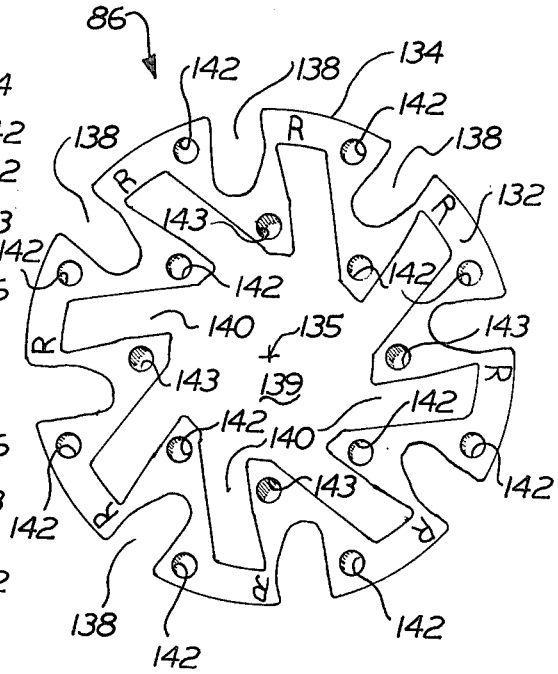
Figure 16:
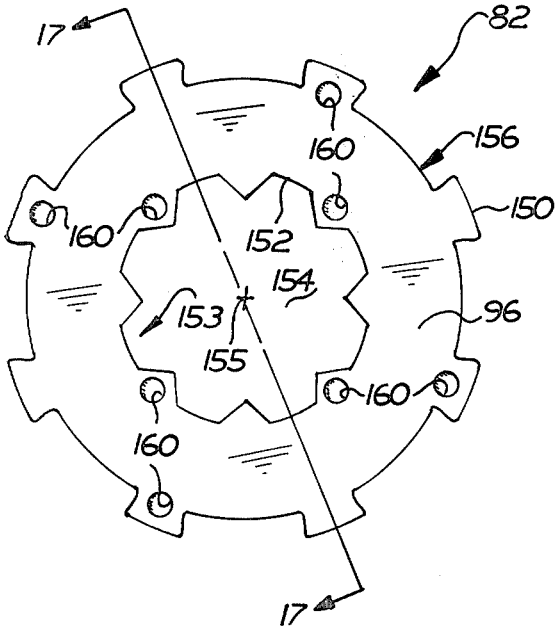
FIG. 16 is a view of an end face of the other end plate member used to construct the commutator valves of FIGS. 3 and 6.
Figure 17:
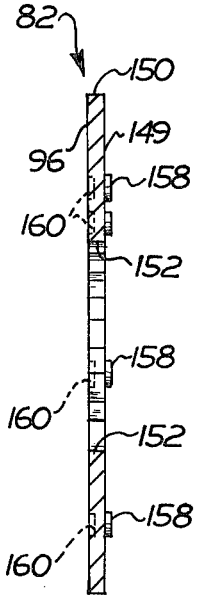
FIG. 17 is a sectional view of the end plate member of FIG. 16, taken along the section line 17—17 of FIG. 16.

Referring to FIGS. 3, 5 and 9, the end plate 80 includes opposite axial end faces 94, 95. The end plate 80 also includes an outer peripheral circular surface 97 and a concentric inner circular surface 99 extending axially between the end faces 94, 95. The inner surface 99 defines a central opening 101 about the central axis 103 of the end plate 80 (FIG. 3).

A circular array of alternating first fluid passageways 100 and second fluid passageways 102 extend through the plate 80 i.e., from surface 94 to surface 95. During operation of the motor, the relative movement of the commutator valve 68 and the stator 50 valves the fluid passageways 100, 102 so that certain of the first fluid passageways 100 communicate with fluid pockets on one side of the line of eccentricity $L_e$ and certain of the fluid passageways 102 communicate with fluid pockets on the other side of the line of eccentricity (see FIG. 2).

Additionally, the plate 80 includes a series of axially extending guide pins 104 which extend outwardly of the end face 95 and aligned axially extending recesses 105 which extend inwardly from end face 94 (FIG. 9). Further, a series of holes 106 extend through the plate 80. The holes 106 form part of recesses 92 in a completed valve.

The end plate 80 is preferably formed of metal, particularly SAE 1010-1020 steel, No. 3 or No. 4 temper. The plate is preferably stamped from a sheet of metal 0.092–0.098 inches thick into the foregoing configuration.

The intermediate plate 84 is shown in further detail in FIGS. 5, 8 and 10–12. Plate 84 includes opposite axial end faces 109, 111, an outer peripheral surface 110 and an inner surface 112 extending axially between the end faces 109, 111. Outer surface 110 forms a first series of inwardly extending flow passages 114 (FIG. 10). Inner surface 112 forms a central opening 115, and a second series of outwardly extending flow passages 116. The flow passages 114 are spaced equally about the outer periphery of the plate and extend generally radially with respect to the central axis 117 of the plate. The flow passages 116 are equidistantly spaced about the inner periphery of the plate and include sidewalls **116*a*, 116*b* each extending at an angle to the radial direction. Additionally, the sidewalls 116*a* of each of the flow passages 116 extend at equal angles to the radial direction and the sidewalls 116*b* of each of the flow passages 116 extend at equal angles to the radial direction. Flow passages 114, 116 extend axially through the plate 84**.

As seen in FIGS. 5, 8 and 12, plate 84 also includes a series of axially extending guide pins 118 extending outwardly of end surface 111 and aligned axially extending recesses 120 extending inwardly of end surface 109. The guide pins 118 and recesses 120 are similar in shape and dimension to the guide pins and recesses in end plate 80. Additionally, a series of holes 121 extend axially through the plate. The holes 121 form part of recesses 92 in a completed valve.

The other intermediate valve plate 86 is illustrated in detail in FIGS. 5, 8 and 13–15. The plate includes opposite axial end faces 130, 132, and outer peripheral surface 134 and an inner surface 136 extending axially between end faces 132, 134. Outer surface 134 defines a first series of inwardly directed flow passages 138 which extend generally radially with respect to the central axis 135 of the plate. Inner surface 136 defines a central opening 139 and a second series of outwardly directed flow passages 140 having sidewalls **140*a*, 140*b* each extending at an angle to the radial direction. Additionally the sidewalls 140*a* of each passage 140 extend at equal angles to the radial direction and the sidewalls 140*b* of each of the flow passages 140 extend at equal angles to the radial direction. Flow passages 138, 140 extend axially through the plate 86**.

In fact, as seen from FIGS. 3, 4 and 10, 11, the flow passages 138, 140 are identical in shape and dimension to the flow passages 114, 116 in intermediate plate 84.

Plate 86 further includes first holes 142 and second holes 143 extending axially therethrough. First holes 142 are oriented and dimensioned to matingly engage the guide pins 118 extending outwardly from plate 84. Additionally, when holes 142 and guide pins 118 are engaged, the flow passages 114 and 138 are aligned with each other and flow passages 116 and 140 are aligned with each other with walls **116*a*, 116*b* aligned, respectively, with walls 140*a*, 140*b*. Further, the holes 143 are aligned with holes 121 in plate 84. Holes 143 form part of recesses 92** in a completed valve.

The end plate 82 is illustrated in FIGS. 5, 8, 16 and 17. The plate includes opposite axial end faces 96, 149, an outer peripheral surface 150 and an inner surface 152 extending axially between end faces 96, 149. Inner surface 152 includes a series of grooves 153 which defines a central opening 154 extending axially through the plate. Outer surface 150 defines a series of arcuate grooves 156 which are spaced about the outer periphery of the plate, and which extend axially through the plate. Grooves 156 also extend generally radially with respect to the central axis 155 of the plate. The plate includes a series of axially extending guide pins 158 extending outwardly from end surface 149 and aligned axially extending recesses 160 extending inwardly of surface 96. The guide pins 158 are designed to matingly engage holes 142 in plate 86 (FIG. 5) or recesses 120 in plate 84 (FIG. 8).

The plates 82, 84 and 86 are formed of the same material and in the same thickness as plate 80. Preferably, all of the plates 80, 82, 84 and 86 are stamped out of sheet metal stock from the same sheet.

In assembling the plates 80, 82, 84 and 86 to form a commutator valve, the intermediate plates 84 and 86 are always assembled with guide pins 118 of plate 84 engaging holes 142 of plate 86. End face 111 of plate 84 is therefore always disposed against end face 130 of plate 86. Flow passages 114, 138 in the plates 84, 86, respectively, are aligned with each other and flow passages 116, 140 in plates 84, 86, respectively, are aligned with each other.

The intermediate plates 84, 86 are further disposed between end plates 80, 82 in one of two different alignments. In a first alignment, shown in FIGS. 3–5, the plate 84 is disposed adjacent end plate 80 and plate 86 is disposed adjacent end plate 82. Guide pins 104 of plate 80 engage the recesses 120 of plate 84, and guide pins 158 of end plate 82 engage holes 142 in plate 86. In a second alignment, shown in FIGS. 6–8, the plate 86 is disposed adjacent end plate 80 and plate 84 is disposed adjacent end plate 82. Guide pins 104 of plate 80 engage the holes 142 of plate 86 and guide pins 158 of plate 82 engage the recesses 120 of plate 84.

In either alignment, holes 106, 121 and 143 in plates 80, 84 and 86 are aligned with each other to form recesses 92. Also, in either alignment, notches 156 of end plate 82 expose portions of the surface of the intermediate plate adjacent thereto. Still further, in either alignment, the central axes 103, 117, 135, 155 of the plates are all aligned, and the central openings 101, 115, 139 and 154 in the plates combine to form central opening 75 of the commutator valve.

To form a completed commutator valve the assembled plates are fixedly secured together by a suitable technique. Preferably, the plates are copper brazed together by a known brazing technique.

When a commutator valve is formed with the plates 84, 86 in the first alignment (FIGS. 3–5) the aligned flow passages 114, 138 in the intermediate plates 84, 86 form outwardly extending flow passages 164. The aligned flow passages 116, 140 in the plates 84, 86 form inwardly extending flow passages 166.

Figure 4:
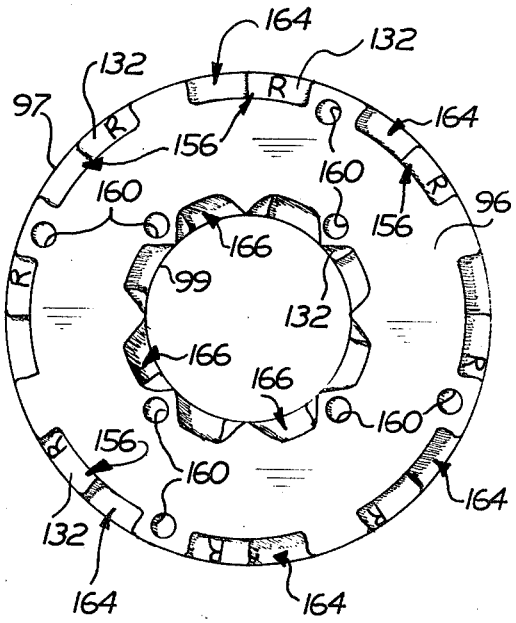
FIG. 4 is a view of the other axial end of the commutator valve of FIG. 3.

When the commutator valve of FIGS. 3–5 is assembled in the motor 10, the outwardly extending flow passages 164 connect fluid passageways 102 with the high pressure space 72. The flow passages 166 connect the fluid passageways 100 with the central valve opening 75 forming part of the low pressure space 74. As seen in FIG. 2, high pressure fluid is directed through flow passages 164 and fluid passageways 102 to the expanding pockets A, B, C and D on one side of the line of eccentricity $L_e$. Low pressure fluid is directed through fluid passageways 100 and flow passages 166 out of contracting pockets E, F, G and H on the other side of the line of eccentricity $L_e$. This places a force couple on the gearset causing the rotor 52 to rotate in one direction (counterclockwise as seen in FIG. 2) and to orbit in an opposite direction. Accordingly, the motor output shaft will rotate in the same direction.

When the commutator valve of FIGS. 6–8 is used in the motor 10 it directs fluid flow to cause the rotor to rotate in an opposite direction. As noted above the commutator valve of FIGS. 6–8 has aligned flow passages 114 and 138 forming outwardly extending flow passages 164. The passages 164 communicate fluid passageways 100 with high pressure space 72. Flow passages 166, formed by the aligned flow passages 116, 140 communicate passages 102 with low pressure space 74. Thus, the valve directs high pressure fluid from high pressure space 72 to expanding pockets on one side of the line of eccentricity through outwardly extending flow passages 164 and fluid passageways 100, and directs low pressure fluid from contracting pockets on the other side of the line of eccentricity to low pressure space 74 through fluid passageways 102 and inwardly extending flow passages 166. Accordingly, the rotor 52 and the output shaft rotate in the opposite direction. A commutator valve assembled as shown in FIGS. 1–5 forms what may be identified as a "right handed" valve because it causes the motor output shaft to rotate in one direction. The surface 132 of plate 86 which is adjacent end plate 82 has a plurality of indicia markings "R" identifying that direction of rotation. When the valve is assembled, the markings "R" are exposed through notches 156 in end plate 82, so that they can be viewed therethrough.

A commutator valve assembled as shown in FIGS. 6–8 forms what may be identified as a "left handed" valve because it causes the motor output shaft to rotate in an opposite direction. The surface 109 of plate 84 which is then adjacent end plate 82 has a plurality of indicia markings "L" thereon identifying that direction of rotation. When the valve is assembled, the markings "L" are exposed through notches 156 in end plates 82, so that they can be viewed therethrough.

The arcuate notches 156 in the end plate 82 are preferably of a great enough peripheral extent that they also align with the flow passages (164 or 168) which communicate with the high pressure space 72 surrounding the valve.

The foregoing commutator valve structure is believed to have various technical attributes. The same set of four plates can be used to form either a "left handed" and "right handed" valve, depending upon alignment of the intermediate plates 84, 86 relative to end plates 80, 82. The markings on the plates 84, 86 can assist in assembling a commutator valve for a motor whose output shaft is intended to rotate in a preselected direction. Further, once a valve has been assembled, the exposed indicia indentify the direction in which the valve will cause the motor output shaft to rotate.

Since the plates are of equal thickness, all four plates can be stamped out of sheet metal stock from the same sheet. This is believed to enhance the compatibility of the plates with the brazing process which fixes them together. The use of plural thin intermediate plates enables flow passages of substantial width to be stamped therein without rough edges. While two intermediate plates are preferred, it should be clear that more than two intermediate plates may be used.

What is claimed is:

1. A commutator valve assembly for directing fluid between expansible and contractible fluid pockets and the high and low pressure ports of a hydraulic device, said valve assembly comprising a plurality of plate members adapted to be fixedly secured together, said plurality of plate members including a first end plate, a second end plate and a plurality of intermediate plates disposed therebetween, said first end plate including first and second arrays of fluid passageways for communicating with the expansible and contractible fluid pockets, said intermediate plates being disposable in either a first or a second alignment between said first and second end plates, said plurality of intermediate plates forming a series of flow passages formed in a pattern for communicating the first array of fluid passageways with the high pressure port and the second array of fluid passageways with the low pressure port when the intermediate plates are in said first alignment and for communicating the second array of fluid passageways with the high pressure port and the first array of fluid passageways with the low pressure port when the intermediate plates are in said second alignment, the flow passages in each of said intermediate plates extending therethrough from one end surface to the other end surface, the flow passages in the end surfaces of each intermediate plate forming patterns which are mirror images of each other, and the positions of said intermediate plates relative to said first end plate in said first position being a reversal of the positions of said intermediate plates relative to said first end plate in said second position.

2. A commutator valve assembly as defined in claim 1 wherein a portion of at least one of said intermediate plates includes indicia for identifying whether the intermediate plates are in said first or second alignment.

3. A commutator valve assembly as defined in claim 2 wherein a first surface of a first one of said intermediate plates includes indicia for identifying the disposition of the intermediate plates in said first alignment, and a second surface of a second one of said intermediate plates includes indicia for identifying the disposition of the intermediate plates in said second alignment.

4. A commutator valve assembly as defined in claim 3 wherein said first surface of said first one of said intermediate plates is disposed adjacent the second end plate when said intermediate plates are in said first alignment, and wherein said second surface of the second intermediate plate is disposed adjacent the second end plate when said intermediate plates are in said second alignment, said second end plate including a plurality of openings extending therethrough for exposing the indicia on the surface portions of the intermediate plate disposed adjacent thereto.

5. A commutator valve assembly as defined in claim 2 wherein said intermediate plates include identical flow passage patterns extending therethrough.

6. A commutator valve assembly as defined in claim 5 wherein said intermediate plates form a central opening for communicating with the low pressure port when said intermediate plates are in either of said first or second alignments, said intermediate plates including outer surface portions for communicating with the high pressure port when said intermediate plates are in either of said first or second alignments, said flow passages in said intermediate plates being designed to place the first array of fluid passageways in said first end plate in fluid communication with said outer surface portions and the second array of fluid passageways in fluid communication with the central opening when the intermediate plates are in said first alignment and to place the first array of the fluid passageways in fluid communication with the central opening and the second array of fluid passageways in fluid communication with the outer surface portions when the intermediate plates are in said second alignment.

7. A commutator valve assembly as defined in claim 2 wherein said end plates and each of the intermediate plates are metal plates of equal thickness.

8. A commutator valve assembly as defined in claim 1 wherein said intermediate plates include a first intermediate plate and a second intermediate plate disposed adjacent each other when said first and second intermediate plates are in either of said first or second alignments, said first intermediate plate being further disposed adjacent said first end plate and said second intermediate plate being further disposed adjacent said second end plate when said intermediate plates are in said first alignment, said second intermediate plate being further disposed adjacent said first end plate and said first intermediate plate being further disposed adjacent said second end plate when said intermediate plates are in said second alignment.

9. A commutator valve assembly as defined in claim 8 wherein said first end plate includes a plurality of first guide pins protruding outwardly from a surface thereof, said second end plate including a series of second guide pins protruding outwardly from a surface thereof, said first intermediate plate including a series of first recesses in one surface thereof for engaging said first or second guide pins and a series of third guide pins protruding outwardly from the other surface thereof, said second intermediate plate including a series of second recesses extending axially therethrough, said second recesses matingly engaging said third guide pins and adapted to matingly engage either said first or second guide pins, the engagement of said third guide pins with said second recesses and said first and second guide pins with said first or second recesses interconnecting said end plates and said intermediate plates in said first or second alignments.

10. A commutator valve assembly as defined in claim 9 wherein said end plates and said first and second intermediate plates are formed of metal plates of equal thickness.

11. Commutator valve means for directing fluid between the expansible and contractible fluid pockets and high and low pressure ports in a hydraulic device wherein the fluid pockets are formed by the intermeshing teeth of a gerotor gearset having a pair of gerotor members adapted for relative rotational and orbital movement, said commutator valve means comprising a plurality of metal plate members fixed together, said plurality of plate members including a first end plate a second end plate and a plurality of intermediate plates disposed between said first and second end plates in a predetermined alignment, said first end plate including first and second arrays of fluid passageways for communicating respectively with the expansible and contractible fluid pockets, said plurality of intermediate plates forming first flow passages for communicating said first array of fluid passageways with the high pressure port and second flow passages for communicating said second array of fluid passageways with the low pressure port, the pattern of said first and second flow passages being such that a reversal of the alignment of at least two intermediate plates would communicate said first array of fluid passageways with the low pressure port and said second array of fluid passageways with the high pressure port.

12. Commutator valve means as defined in claim 11 wherein said plurality of metal plate members are of equal thickness.

13. Commutator valve means ad defined in claim 12 wherein said plurality of metal plates are brazed together.

14. Commutator valve means as defined in claim 13 wherein a portion of one of the intermediate plates includes indicia identifying which of the first and second arrays of fluid passageways are communicated with the high pressure port.

* * * * *